US008115727B2

(12) United States Patent
Jan et al.

(10) Patent No.: US 8,115,727 B2
(45) Date of Patent: Feb. 14, 2012

(54) SYSTEM FOR DISPLAYING IMAGE

(75) Inventors: Chueh-Kuei Jan, Taipei (TW); Ching-Wei Lin, Taoyuan (TW); Meng-Hsun Hsieh, Taichung (TW)

(73) Assignee: Chimei Innolux Corporation, Miao-Li County (TW)

( * ) Notice: Subject to any disclaimer, the term of this patent is extended or adjusted under 35 U.S.C. 154(b) by 1400 days.

(21) Appl. No.: 11/420,304

(22) Filed: May 25, 2006

(65) Prior Publication Data

US 2007/0273636 A1 Nov. 29, 2007

(51) Int. Cl.
*G09G 3/36* (2006.01)

(52) U.S. Cl. ..... 345/100; 345/98; 345/99; 345/204; 377/64; 377/67

(58) Field of Classification Search ..... 345/98–100; 377/64–81

See application file for complete search history.

(56) References Cited

U.S. PATENT DOCUMENTS

2004/0150607 A1* 8/2004 Nakajima et al. ..... 345/100
2005/0134352 A1 6/2005 Yokoyama et al.
2006/0013352 A1 1/2006 Lin et al.
2006/0221012 A1* 10/2006 Ikeda ..... 345/76
2006/0279512 A1* 12/2006 Kim et al. ..... 345/100

FOREIGN PATENT DOCUMENTS

CN 1680991 10/2005

OTHER PUBLICATIONS

U.S. Appl. No. 11/380,007, filed Apr. 25, 2006, entitled "Systems and Methods for Providing Driving Voltages to a Display Panel".
Office Action of Chinese patent application issued on Feb. 12, 2010.

* cited by examiner

*Primary Examiner* — Lun-Yi Lao
*Assistant Examiner* — Insa Sadio
(74) *Attorney, Agent, or Firm* — Thomas|Kayden

(57) ABSTRACT

Systems for displaying images are provided. A representative system incorporates a digital data sampling circuit with N stage data inputs. The first stage flip-flop outputs a first output signal. The second stage flip-flop outputs a second output signal. The first stage sample latch circuit receives digital data according to a first control signal. The first stage logic circuit comprises a first converter for inverting the second output signal and generating a first inverse logic signal, and generates the first control signal according to the first output signal and the first inverse logic signal.

17 Claims, 11 Drawing Sheets

SYSTEM FOR DISPLAYING IMAGE

BACKGROUND OF THE INVENTION

1. Field of the Invention

The invention relates to a digital data sampling circuit. In particular, the invention relates to a shift register structure of the low-power digital data sampling circuit in a display panel.

2. Description of the Related Art

FIG. 1 shows digital data DATA transmitting and sampling in a conventional liquid crystal display. Digital data DATA through interface circuit 12 and delay buffers 14 is transmitted to each sample latch circuit 16 serially. Shift register 18 provides control signals (SP1, SP2, SP3 . . . SP(n−1), SPn) serially to trigger each sample latch circuit 16 serially. Thus each sample latch circuit 16 serially samples digital data DATA. In a conventional digital data sampling circuit, digital data DATA arrives at sample latch circuit 16 earlier than control signals (SP1, SP2, SP3 . . . SP(n−1), SPn). Therefore, a plurality of delay buffers 14 are used to delay digital data DATA for synchronizing control signals (SP1, SP2, SP3 . . . SP(n−1), SPn) and digital data DATA received by sample latch circuit 16.

FIG. 2 is timing diagram illustrate digital data DATA and control signals (SP1, SP2, SP3 . . . SP(−1), SPn) of the conventional liquid crystal displays. Because of delay buffers 14, control signals (SP1, SP2, SP3 . . . SP(n−1), SPn) and digital data DATA will arrive at sample latch circuit 16 in the same time. In FIG. 2, when start pulse horizontal signal STH is at high voltage level and clock horizontal signal CKH is triggered to high voltage level, first output signal OUT1 is triggered to high voltage level. When clock horizontal signal CKH switches to low voltage level, second output signal OUT2 is triggered to high voltage level. In addition, first control signal SP1 is the logical AND result of first output signal OUT1 and second output signal OUT2. Thus, when first output signal OUT1 and second output signal OUT2 both are at high voltage level, first control signal SP1 is at high voltage level. When start pulse horizontal signal STH is at low voltage level and clock horizontal signal CKH is also triggered to high voltage level, first output signal OUT1 switches to low voltage level. At the same time, first control signal SP1 also switches to low voltage level. Second control signal SP2 immediately switches to high voltage level after first control signal SP1 switches to low voltage level. Third control signal SP3 is also triggered to high voltage level immediately after second control signal SP2 switches to low voltage level. Each control signal (SP1, SP2, SP3 . . . SP(n−1), SPn) serially transmits to each sample latch circuit 16.

The conventional technology uses a plurality of delay buffers 14 to synchronize control signals (SP1, SP2, SP3 . . . SP(n−1), SPn) and digital data DATA received by sample latch circuit 16. However, delay buffers 14 would consume considerable power and increase costs or layout area. As transmission speed of digital data DATA increases, the power consumption for data transmission is also increased.

BRIEF SUMMARY OF THE INVENTION

Systems for displaying images are provided. In this regard, an embodiment of such as system provides a digital data sampling circuit with N stage data inputs, comprising a first stage flip-flop outputting a first output signal, a second stage flip-flop outputting a second output signal, a first stage sample latch circuit receiving digital data according to a first control signal and a first stage logic circuit comprising a first inverter inverting the second output signal to generate a first inverse logic signal, and generating the first control signal according to the first output signal and the first inverse logic signal.

In addition, an embodiment of a system provides a digital data sampling circuit with N stage data inputs, comprising a first stage flip-flop outputting a first output signal, a second stage flip-flop outputting a second output signal, a first stage sample latch circuit receiving digital data according to a first control signal and a first stage logic circuit comprising a first inverter inverting the second output signal to generate a first inverse logic signal, and generating the first control signal according to the first output signal and the first inverse logic signal.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 3:
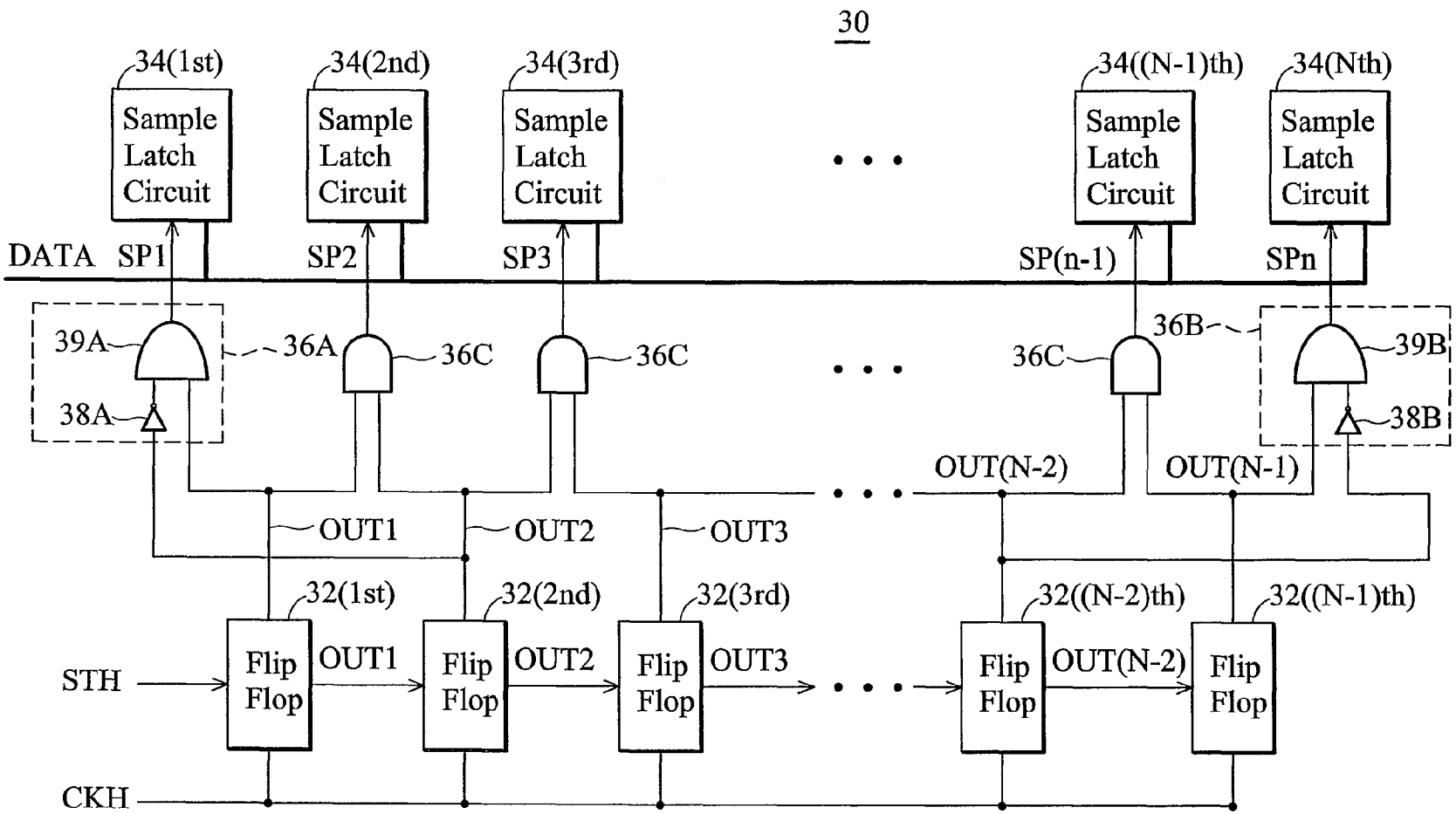
FIG. 3 shows a digital data sampling circuit according to a first embodiment of the invention.

FIG. 3 shows a digital data sampling circuit 30 according to a first embodiment of the invention. Digital data sampling circuit 30 comprises (N−1) stages flip-flop 32(1st~(N−1)th), logic circuits (36A, 36B and 36C) and sample latch circuits 34(1st~Nth). Each stage flip-flop 32(1st~(N−1)th) respectively receives start pulse horizontal signal STH and clock horizontal signal CKH, and transmits and receives output signal (OUT1, OUT2 . . . OUT(N−1)). Each stage sample latch circuit 34(1st~Nth) serially receives digital data DATA according to each control signal (SP1~SPn).

First stage logic circuit 36A comprises an inverter 38A and an AND logic gate 39A. Inverter 38A inverts second stage output signal OUT2 from second stage flip-flop 32(2nd) and generates an inverting logic signal. AND logic gate 39A is coupled between inverter 38A and first stage sample latch circuit 34(1st). AND gate 39A receives the inverting logic signal from inverter 38A and first stage output signal OUT1 from first stage flip-flop 32(1st) producing first control signal SP1.

Nth stage logic circuit 36B comprises an inverter 38B and an AND logic gate 39B. Inverter 38B inverts (N−2)th stage output signal OUT(N−2) from (N−2)th stage flip-flop 32((N−2)th) and generates an inverting logic signal. AND logic gate 39B is coupled between inverter 38B and Nth stage sample latch circuit 34(Nth). AND gate 39B receives the inverting logic signal from inverter 38B and (N−1)th stage output signal OUT(N−1) from (N−1)th stage flip-flop 32((N−1)th) for producing Nth control signal SPn.

According to the embodiment of the invention, each stage logic circuit 36C may be an AND logic gate. Using a second stage logic circuit as an example, the second stage AND logic gate 36C is coupled between second stage sample latch circuit 34(2nd) and second stage flip-flop 32(2nd), and receives first stage output signal OUT1 from first stage flip-flop 32(1st) and second stage output signal OUT2 from second stage flip-flop 32(2nd) for producing second control signal SP2.

Figure 4:
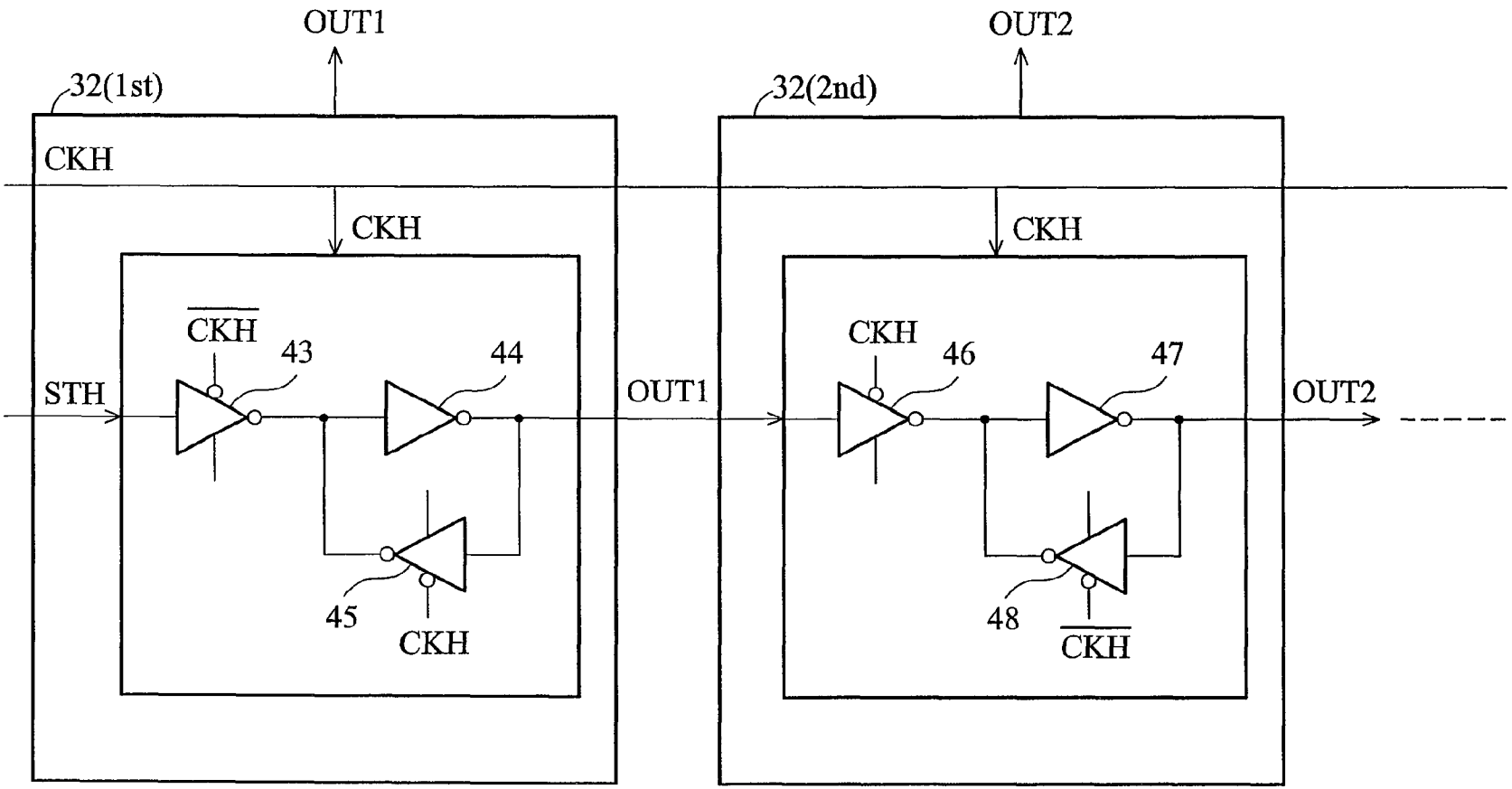
FIG. 4 shows D-type flip-flop schematic circuit according to an embodiment of the invention.

FIG. 4 shows first stage flip-flop 32(1st) and second stage flip-flop 32(2nd) according to the embodiment of the invention. The embodiment uses the D-type flip-flop as each stage flip-flop 32(1st~(N−1)th) and the circuit structure of each two stage D-type flip-flops is similar. First stage flip-flop 32(1st) receives clock horizontal signal CKH and start pulse horizontal signal STH respectively and transmits first stage output signal OUT1. First stage flip-flop 32(1st) comprises inverters 43~45. The output of inverter 44 is coupled to the input of inverter 45. The output of inverter 45 is coupled to the input of inverter 44. Inverter 43 receives and inverts start pulse horizontal signal STH and outputs to the input of inverter 44.

Second stage flip-flop 32(2nd) receives clock horizontal signal CKH and first stage output signal OUT1 respectively and transmits second stage output signal OUT2. Second stage flip-flop 32(2nd) comprises inverters 46~48. The output of inverter 47 is coupled to the input of inverter 48. Inverter 46 receives and inverts first stage output signal OUT1 and output to the input of inverter 47.

When clock horizontal signal CKH is at high voltage level, first stage D-type flip-flop 32(1st) transfers the voltage level of start pulse horizontal signal STH to first stage output signal OUT1. When clock horizontal signal CKH is at low voltage level, second stage D-type flip-flop 32(2nd) transfers the voltage level of first stage output signal OUT1 to second stage output signal OUT2. The other stage flip-flop is similar to the above D-type flip-flop.

Figure 5:
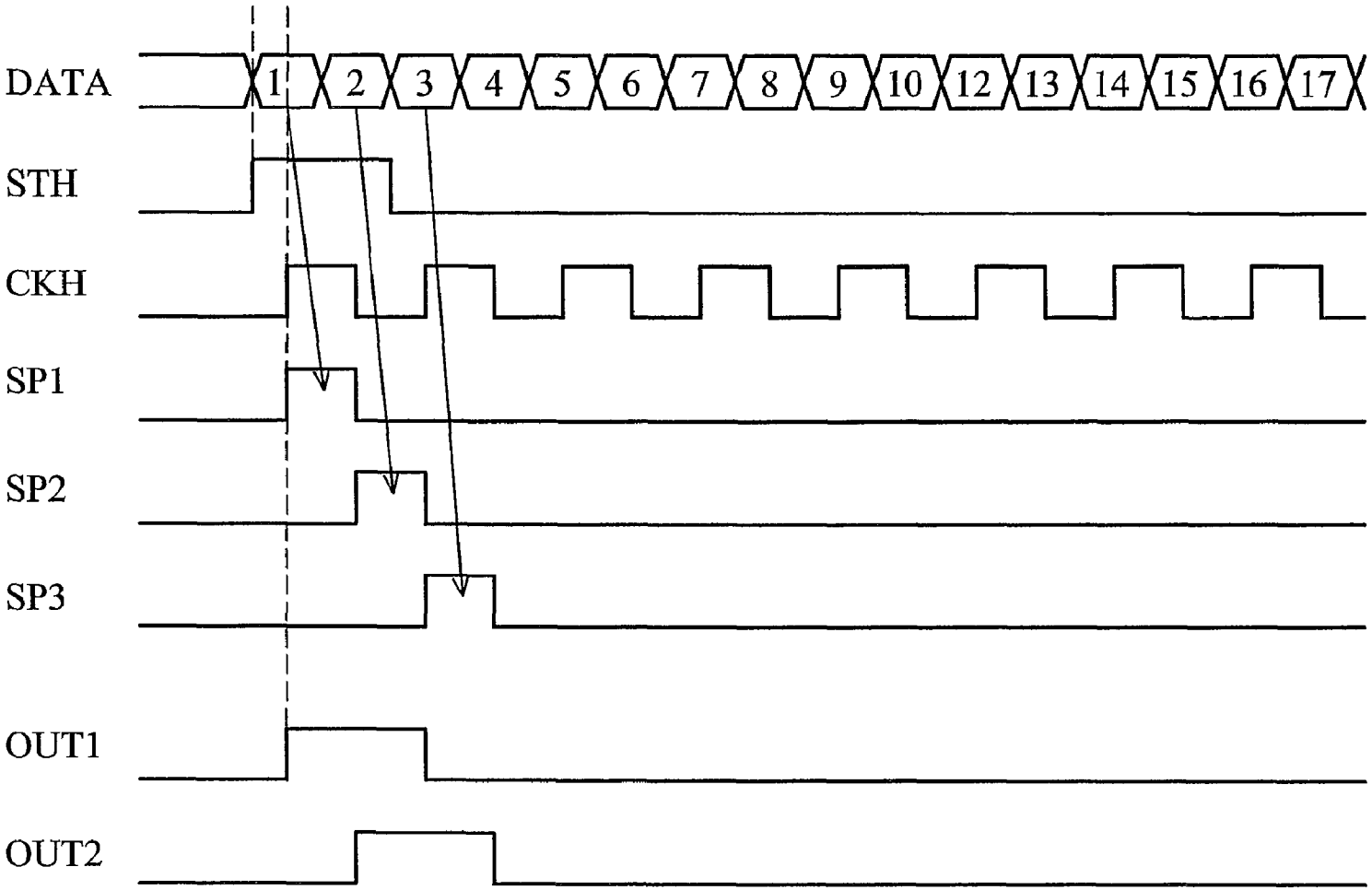
FIG. 5 shows synchronization of the digital data and control signal according to an embodiment of the invention.

FIG. 5 shows that digital data DATA and control signals (SP1, SP2, SP3 . . . SP(n−1), SPn) are synchronous according to the embodiment of the invention. Using the digital data sampling circuit of the first embodiment of the invention illustrates the relationship of each signal in time domain. When one of control signals (SP1, SP2, SP3 . . . SP(n−1), SPn) is triggered to high voltage level, the corresponding sample latch circuit 34(1st~Nth) receives digital data DATA. Therefore, if it can trigger each control signal (SP1, SP2, SP3 . . . SP(n−1), SPn) in serial, it can serially transmit digital data DATA to an LCD display.

In the first embodiment of the invention, clock horizontal signal CKH transmits to each stage flip-flop 32(1st~(N−1)th) and triggers each stage flip-flop to receive output signal (OUT1, OUT2 . . . OUT(N−1)) from each prior stage flip-flop. For example, when clock horizontal signal CKH is at high voltage level, first stage flip-flop 32(1st) receives start pulse horizontal signal STH and transmits first stage output signal OUT1 to second stage flip-flop 32(2nd). When clock horizontal signal CKH is at low voltage level, second stage flip-flop 32(2nd) receives first stage output signal OUT1 and transmits second stage output signal OUT2 to third stage flip-flop 32(3rd).

When first stage output signal OUT1 is triggered to high voltage level and second stage output signal OUT2 is at low voltage level, first inverter 38A inverts second stage output signal OUT2 to high voltage level. The inverting second stage output signal OUT2 (high voltage level) and the first stage output signal OUT1 (high voltage level) both input to AND logic gate 39A. Thus, first stage control signal SP1 is also triggered to high voltage level. When second stage output signal OUT2 is triggered to high voltage level and first stage output signal OUT1 is at high voltage level, simultaneously second stage control signal SP2 is triggered to high voltage level and first control signal SP1 switches to low voltage level.

When N−2 stage output signal OUT (N−2) is at high voltage level and N−1 stage output signal OUT(N−1) is also triggered to high voltage level, N−1 stage control signal SP(n−1) is triggered to high voltage level simultaneously. When N−2 stage output signal OUT(N−2) switches to low voltage level, inverter 38B inverts N−2 stage output signal OUT(N−2) to high voltage level. Inverting N−2 stage output signal OUT(N−2) (high voltage level) and N−1 stage output signal OUT(N−1) (high voltage level) both input to AND logic gate 39B. Thus, N stage control signal SPn is triggered to high voltage level and N−1 stage control signal SP(n−1) switches to low voltage level. Therefore, each control signal (SP1, SP2, SP3 . . . SP(n−1), SPn) is triggered to high voltage level serially.

Figure 6:
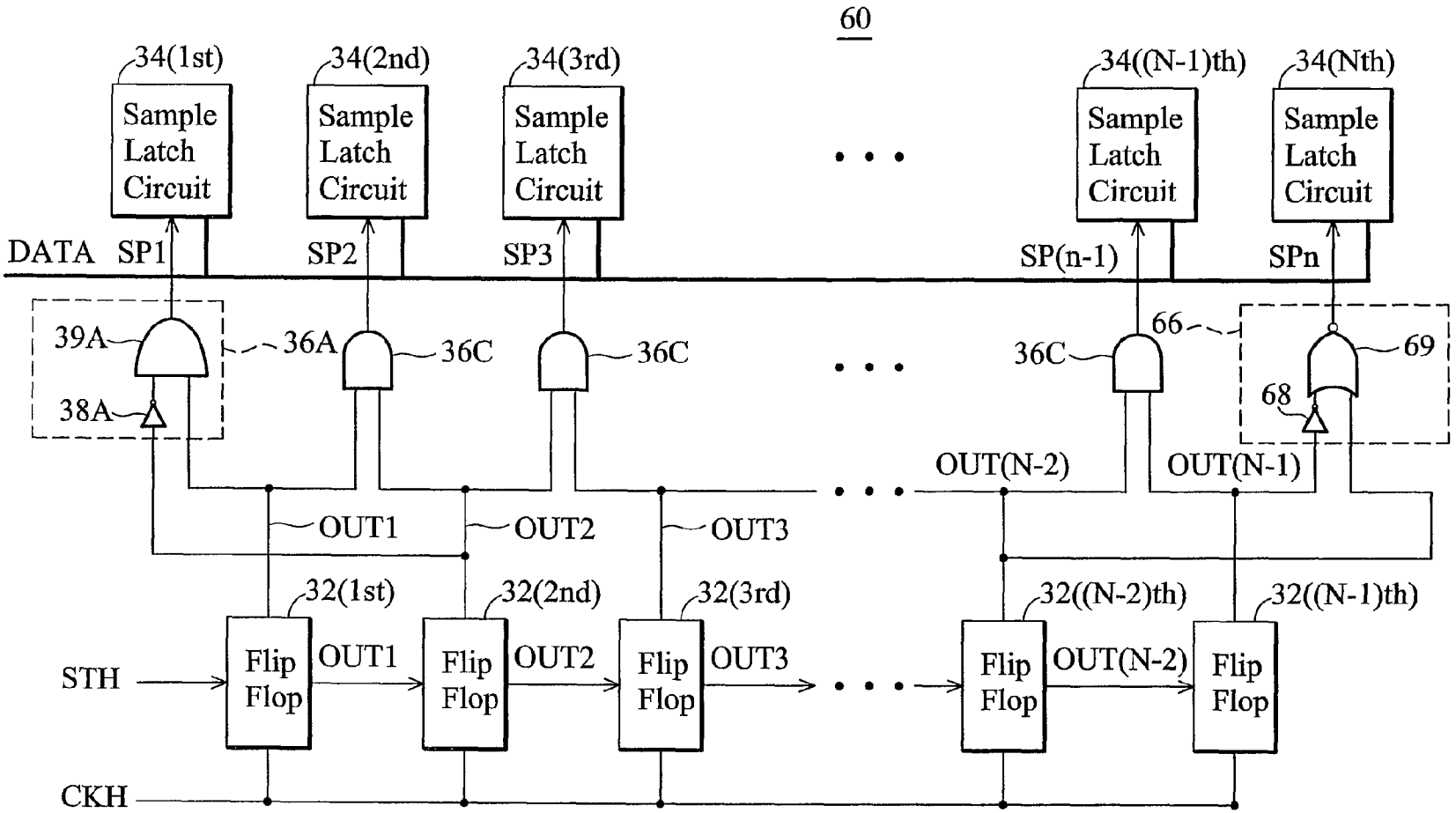
FIG. 6 shows a digital data sampling circuit according to a second embodiment of the invention.

FIG. 6 shows a digital data sampling circuit 60 according to a second embodiment of the invention. The difference between the first embodiment and the second embodiment is the circuit structure of the N stage logic circuit 66.

According to the second embodiment of the invention, an N stage logic circuit 66 comprises an inverter 68 and a NOR logic gate 69. Inverter 68 inverts N−1 stage output signal OUT(N−1) from N−1 stage flip-flop 32((N−1)th) and generates an inverting logic signal. NOR logic gate 69 is coupled between inverter 68 and N stage sample latch circuit 34(Nth). NOR logic gate 69 bases on the receiving inverting signal from inverter 68 and N−2 stage output signal OUT(N−2) from N−2 stage flip-flop 32((N−2)th) to generate N stage control signal SPn.

Figure 7:
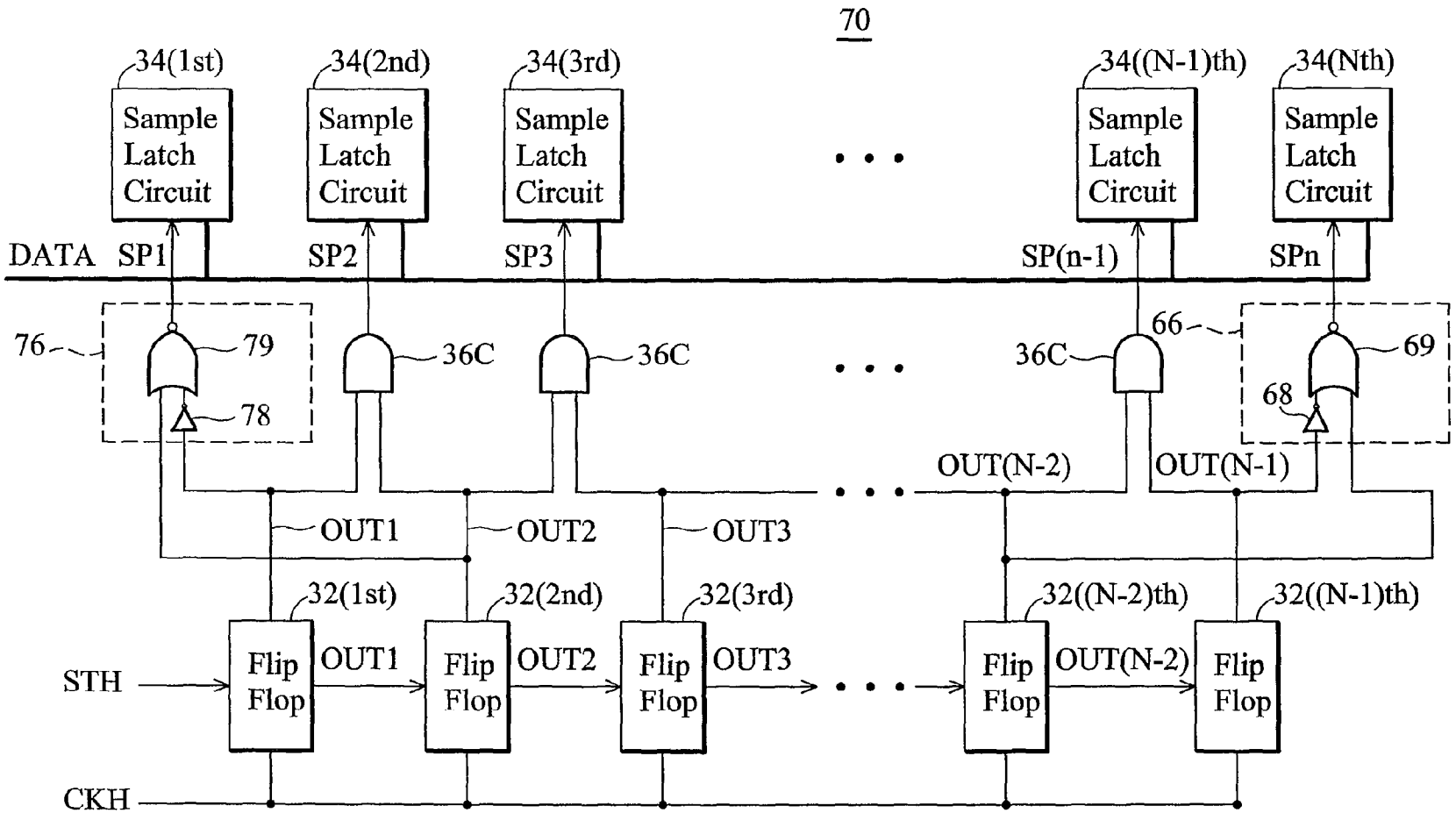
FIG. 7 shows a digital data sampling circuit according to a third embodiment of the invention.

FIG. 7 shows a digital data sampling circuit 70 according to a third embodiment of the invention. The difference between the second embodiment and the third embodiment is the circuit structure of the first stage logic circuit 36A.

According to the third embodiment of the invention, a first stage logic circuit 76 comprises an inverter 78 and a NOR logic gate 79. Inverter 78 inverts first stage output signal OUT1 from first stage flip-flop 32(1st) and generates an inverting logic signal. NOR logic gate 79 is coupled between inverter 78 and first stage sample latch circuit 34(1st). NOR logic gate 79 bases on the receiving inverting signal from inverter 78 and second stage output signal OUT2 from second stage flip-flop 32(2nd) to generate first stage control signal SP1.

Figure 8:
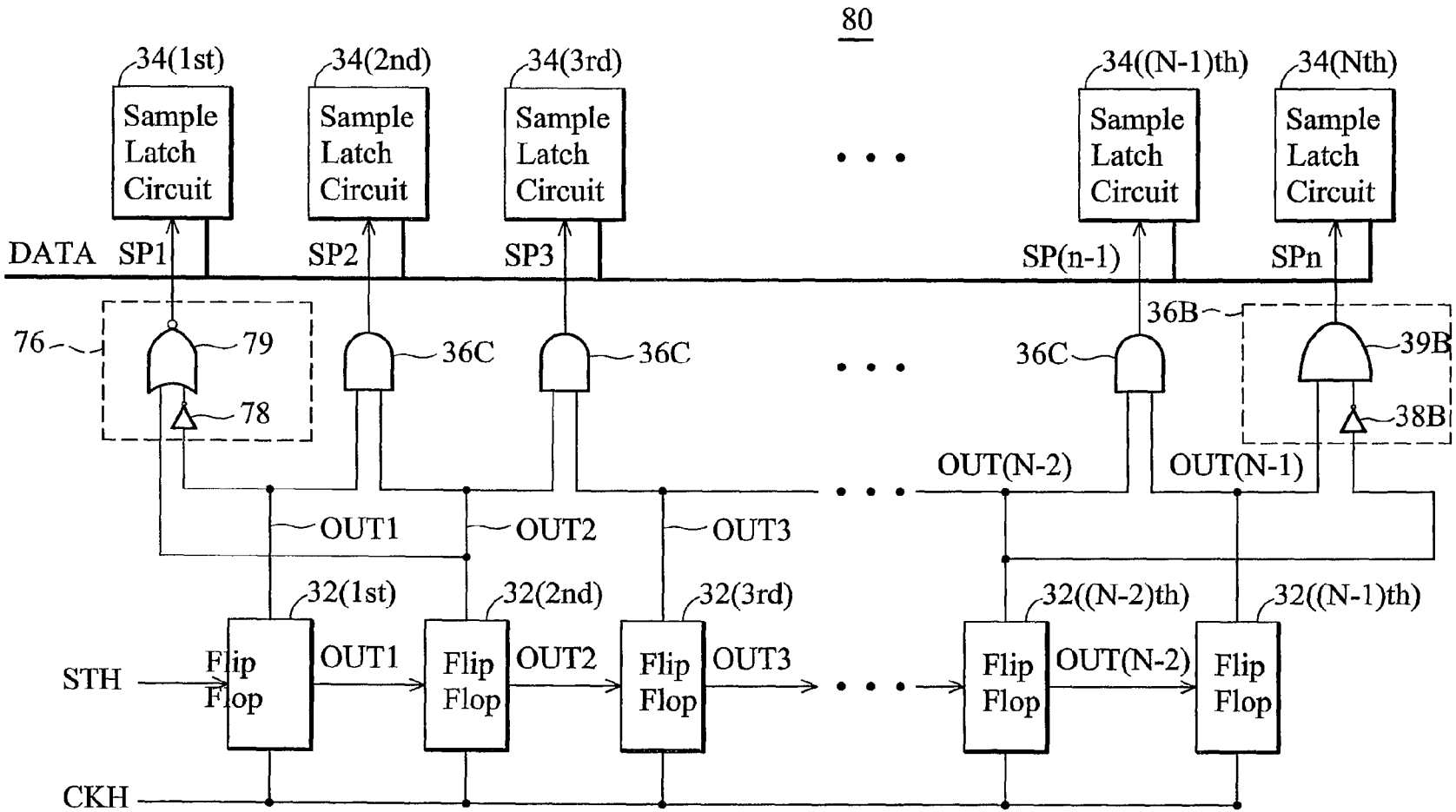
FIG. 8 shows a digital data sampling circuit according to a fourth embodiment of the invention.

FIG. 8 shows a digital data sampling circuit 80 according to a fourth embodiment of the invention. The difference between the first embodiment and the fourth embodiment is the circuit structure of the first stage logic circuit 36A.

According to the fourth embodiment of the invention, a first stage logic circuit 76 comprises an inverter 78 and an NOR logic gate 79. Inverter 78 inverts first stage output signal OUT1 from first stage flip-flop 32(1st) and generates an inverting logic signal. NOR logic gate 79 is coupled between inverter 78 and first stage sample latch circuit 34(1st). NOR logic gate 79 bases on the receiving inverting signal from inverter 78 and second stage output signal OUT2 from the second stage flip-flop 32(2nd) to generate first stage control signal SP1.

Figure 9:
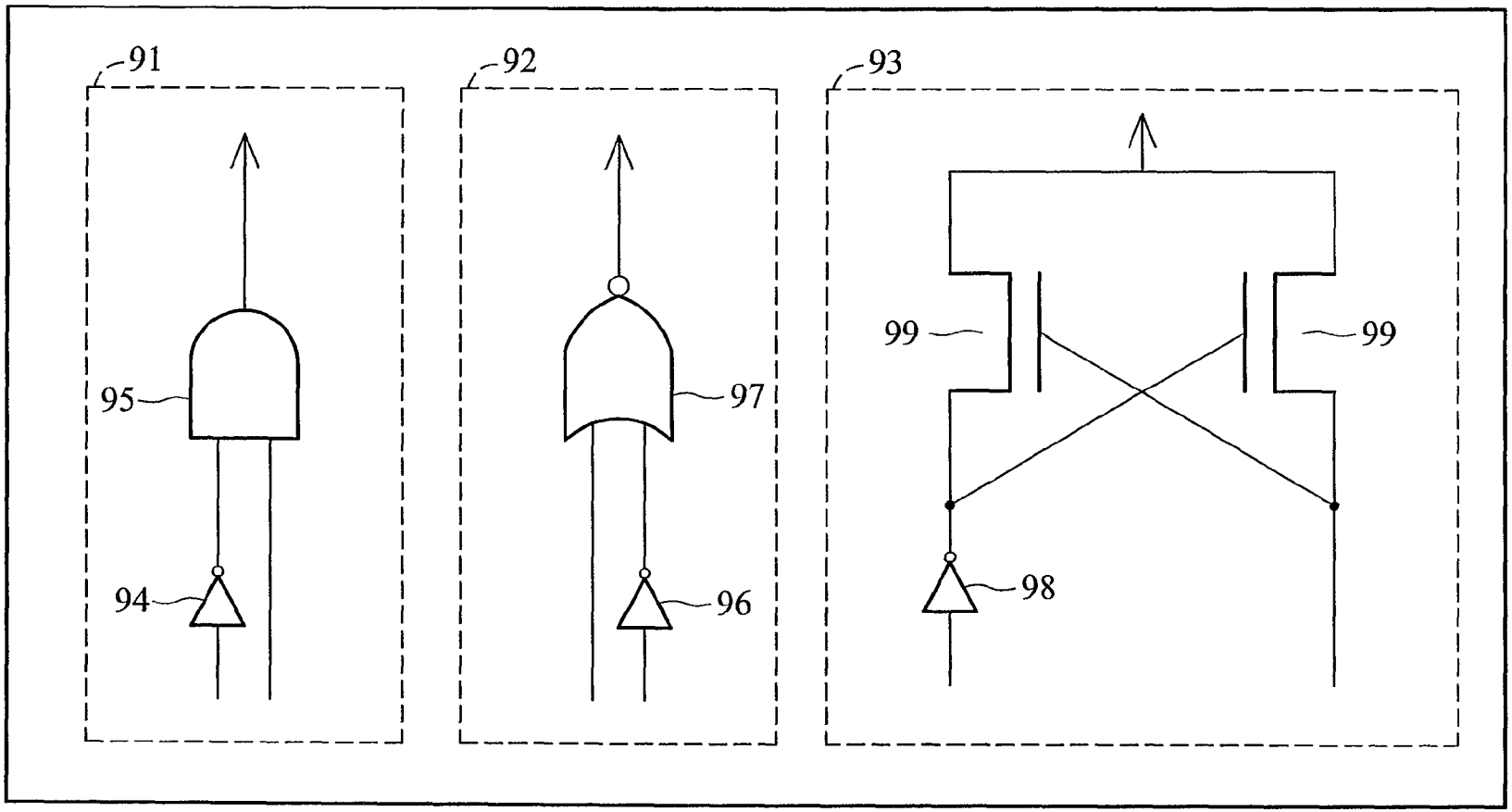
FIG. 9 shows three kinds of logic circuits in the first stage logic circuit.

FIG. 9 shows three kinds of logic circuits. A logic circuit 91 comprises an AND logic gate 95 and an inverter 94. A logic circuit 92 comprises an NOR logic gate 97 and an inverter 96. A logic circuit 93 comprises two MOS (metal oxide semiconductor) transistors 99 and an inverter 98. Because the Boolean result of three kinds of logic circuits in FIG. 9 are the same, logic circuits 91, 92 and 93 in FIG. 9 have the same function and can substitute for logic circuit 36A. For example, logic circuit 91 is logic circuit 36A in FIG. 3 and logic circuit 92 is logic circuit 76 in FIG. 7.

Figure 10:
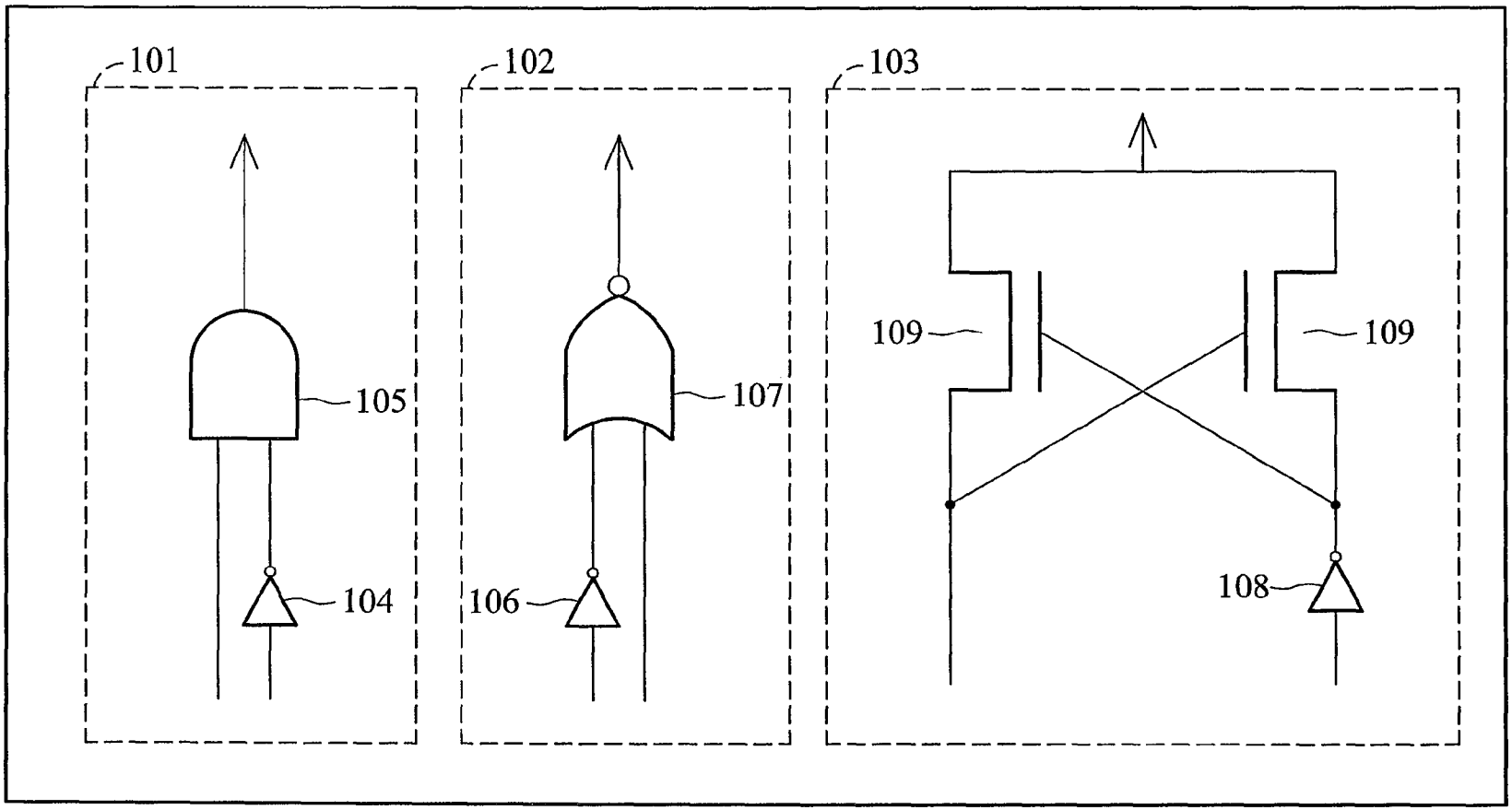
FIG. 10 shows three kinds of logic circuits in the Nth stage logic circuit.

FIG. 10 shows three kinds of logic circuits. A logic circuit 101 comprises an AND logic gate 105 and an inverter 104. A logic circuit 102 comprises an NOR logic gate 107 and an inverter 106. A logic circuit 103 comprises two MOS (metal-oxide-semiconductor) transistors 109 and an inverter 108. Because the Boolean result of three kinds of logic circuits in FIG. 10 are the same, logic circuits 101, 102 and 103 in FIG. 10 have the same function and can substitute for logic circuit 36B. For example, logic circuit 101 is logic circuit 36B in FIG. 3 and logic circuit 102 is logic circuit 66 in FIG. 6.

Therefore, the digital data sampling circuit 60 in FIG. 6, the digital data sampling circuit 70 in FIG. 7 and the digital data sampling circuit 80 in FIG. 8 all have the same function which the digital data sampling circuit 30 in FIG. 3 has.

Figure 11:
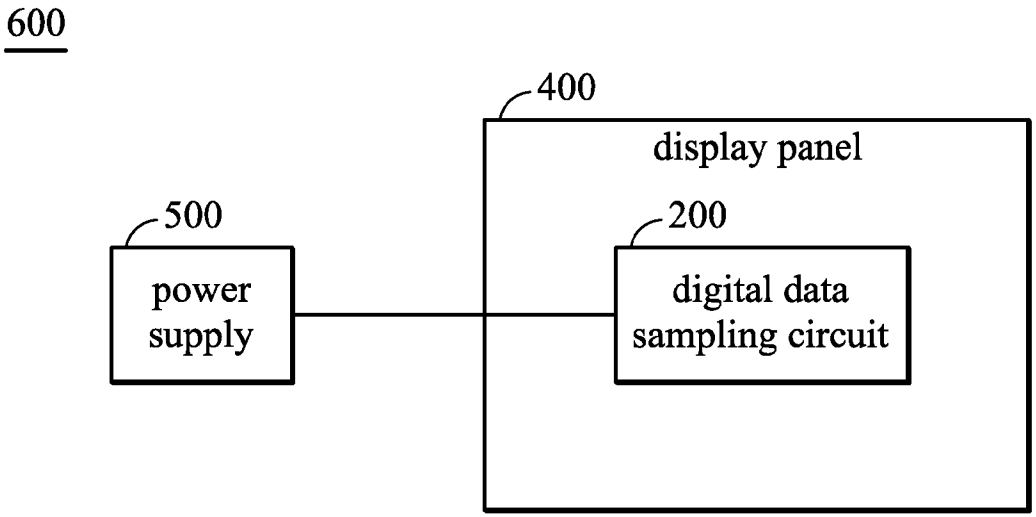
FIG. 11 schematically shows another embodiment of a system for displaying images.

FIG. 11 schematically shows another embodiment of a system for displaying images which, in this case, is implemented as a display panel 400 or an electronic device 600. As shown in FIG. 11, the display panel 400 comprises a digital data sampling circuit 200. The display panel 400 can form a portion of a variety of electronic devices (in this case, electronic device 600). Generally, the electronic device 600 can comprise the display panel 400 and a power supply 500. Further, the power supply 500 is operatively coupled to the display panel 400 and provides power to the display panel 400. The electronic device 600 can be a mobile phone, digital camera, PDA (personal data assistant), notebook computer, desktop computer, television, or portable DVD player, for example.

Figure 1:
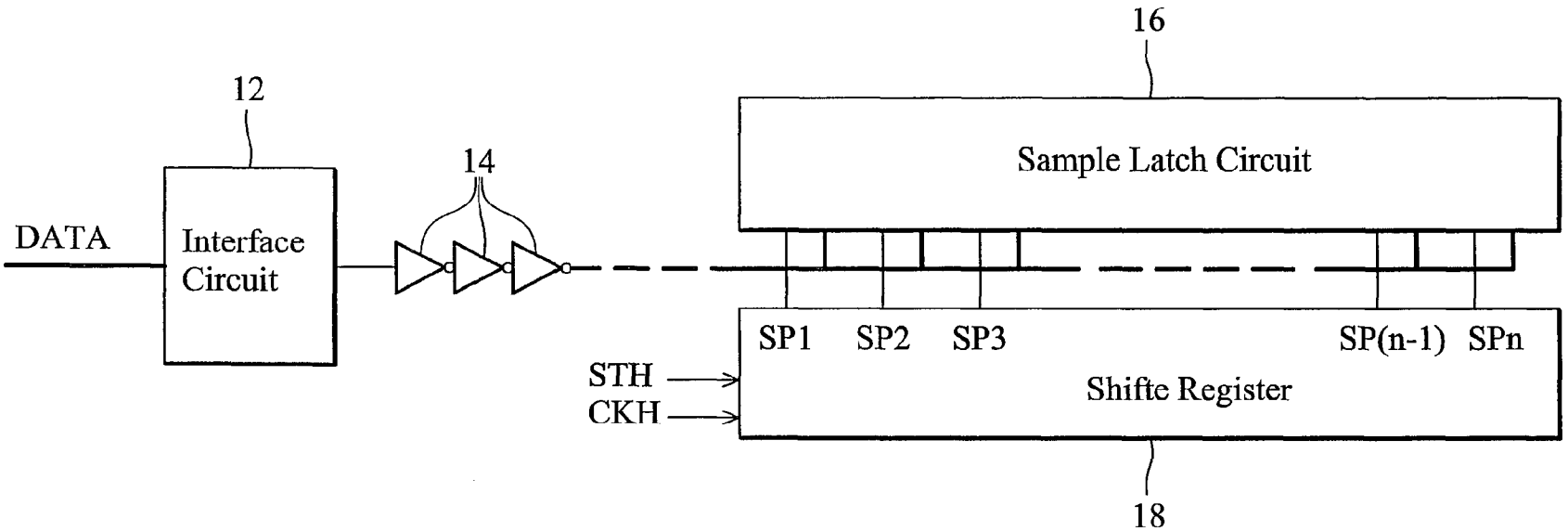
FIG. 1 ( RELATED ART )
FIG. 1 shows digital data transmission and sampling in a conventional liquid crystal display.
Figure 2:
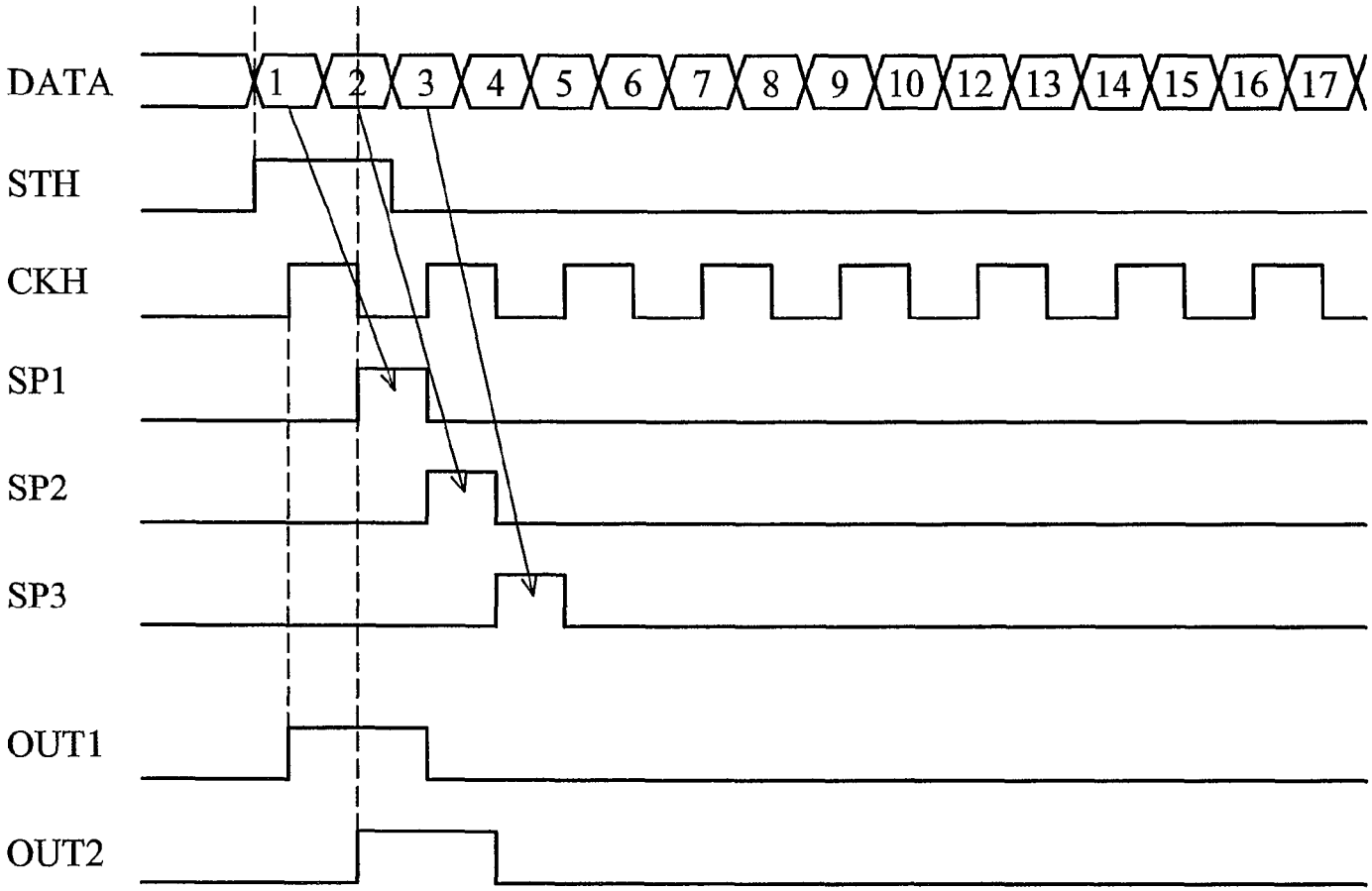
FIG. 2 ( RELATED ART )
FIG. 2 is timing diagram illustrating digital data DATA and control signals (SP1, SP2, SP3 . . . SP(n−1), SPn) of the conventional liquid crystal displays.

According to the embodiment of the invention, digital data sampling circuit (30, 60, 70 and 80) can in advance generate control signals (SP1, SP2, SP3 . . . SP(n−1), SPn). For example, according to the embodiment of the invention, control signals (SP1, SP2, SP3 . . . SP(n−1), SPn) of digital data sampling circuit 30 in FIG. 5 are half clock period earlier than control signals (SP1, SP2, SP3 . . . SP(n−1), SPn) in FIG. 2. Therefore, it can use less delay buffers to achieve the same goal that digital data DATA and control signals (SP1, SP2, SP3 . . . SP(n−1), SPn) synchronize and consume less power, less layout area and cost less in circuit design.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A system for displaying image, comprising: a digital data sampling circuit with N stage data inputs; wherein N is an integer number greater than 2, comprising: a first stage flip-flop outputting a first output signal; a second stage flip-flop outputting a second output signal; a (K−1)th stage flip-flop outputting a (K−1)th output signal; a Kth stage flip-flop outputting a Kth output signal; a first stage sample latch circuit receiving digital data according to a first control signal; a second stage sample latch circuit receiving the digital data according to a second control signal; a K stage sample latch circuit receiving the digital data according to a Kth control a first stage logic circuit comprising a first inverter inverting one of the first output signal and the second output signal to generate a first inverse logic signal, and generating the first control signal according to another one of the first and the second output signal and the first inverse logic signal; and a second stage logic circuit generating the second control signal according to the first output signal and the second output signal; and a Kth stage logic circuit generating the Kth control signal according to the (K−1)th output signal and the Kth output signal without via any inverter when K is not equal to 1 nor N; only the first and the last AND logic gate in the stage logic circuit are directly connected to the respective inverters.

2. The system as claimed in claim 1, wherein the first stage logic circuit further comprises a first AND logic gate, the first AND logic gate is coupled between the first inverter and the first stage sample latch circuit.

3. The system as claim in claim 2, wherein the first stage logic circuit further comprises:

a first transistor having a first control gate, a first terminal and a second terminal;

a second transistor having a second control gate coupled to the second terminal, a third terminal coupled to the first terminal and a fourth terminal coupled to the first control gate; and wherein one of the first control gate and the second control gate is coupled to the first inverter.

4. The system as claim in claim 3, wherein the first transistor and the second transistor are NMOS transistors.

5. The system as claimed in claim 1, wherein the first stage logic circuit further comprises a first NOR logic gate, the first NOR logic gate is coupled between the first inverter and the first stage sample latch circuit.

6. The system as claimed in claim 1, further comprising:

an (N−2)th stage flip-flop outputting a (N−2)th output signal;

an (N−1)th stage flip-flop outputting a (N−1)th output signal; and an Nth stage sample latch circuit receiving the digital data according to a Nth control signal.

7. The system as claimed in claim 6, further comprising an Nth stage logic circuit having a second inverter inverting one of the (N−2)th output signal and the (N−1)th output signal to a second inverse logic signal, and generating the Nth control signal according to another one of the (N−2)th and the (N−1)th output signal and the second inverse logic signal.

8. The system as claimed in claim 7, wherein the Nth stage logic circuit further comprises a second AND logic gate, the second AND logic gate is coupled between the second inverter and the Nth stage sample latch circuit.

9. The system as claim in claim 7, wherein the Nth stage logic circuit comprises a first NOR logic gate, the first NOR logic gate is coupled between the second inverter and the Nth stage sample latch circuit.

10. The system as claim in claim 7, wherein the Nth stage logic circuit further comprises:

a third transistor having a third control gate, a first terminal and a second terminal; and a fourth transistor having a fourth control gate coupled to the second terminal, a third terminal coupled to the first terminal and a fourth terminal coupled to the first control gate; and wherein one of the third control gate and the fourth control gate is coupled to the second inverter.

11. The system as claim in claim 10, wherein the first transistor and the second transistor are NMOS transistors.

12. The system as claim in claim 1, wherein the first flip-flop and the second flip-flop are D-type flip-flops.

13. The system as claim in claim 1, wherein the digital data is digital display data.

14. The system as claimed in claim 1, further comprising a display panel, wherein the digital data sampling circuit forms a portion of the display panel.

15. The system as claimed in claim 1, further comprising an electronic device, wherein the electronic device comprises:

the display panel; and an power supply coupled to the display panel and providing power to the display panel.

16. The system as claimed in claim 1, wherein the second stage logic circuit receives the first output signal and the second output signal, and generates the second control signal according to the first output signal and the second output signal.

17. The system as claimed in claim 1, wherein the second stage logic circuit is an AND logic gate.

* * * * *